US011777190B2

(12) United States Patent
Acker et al.

(10) Patent No.: US 11,777,190 B2
(45) Date of Patent: Oct. 3, 2023

(54) APPLIANCE INCLUDING AN ANTENNA USING A PORTION OF APPLIANCE AS A GROUND PLANE

(71) Applicant: WHIRLPOOL CORPORATION, Benton Harbor, MI (US)

(72) Inventors: Rachael Acker, East Lansing, MI (US); Zachary J. Bruin-Slot, Baroda, MI (US); Wyndham F. Gary, Jr., Whitefish Bay, WI (US); David W. Mundy, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1108 days.

(21) Appl. No.: 14/982,137

(22) Filed: Dec. 29, 2015

(65) Prior Publication Data

US 2017/0187091 A1 Jun. 29, 2017

(51) Int. Cl.
*H05B 6/76* (2006.01)
*H01Q 1/22* (2006.01)
(Continued)

(52) U.S. Cl.
CPC ..... *H01Q 1/22* (2013.01); *H01Q 1/38* (2013.01); *H05B 6/6414* (2013.01); *H05B 6/6447* (2013.01)

(58) Field of Classification Search
CPC ... F24C 7/00; F24C 7/082; H05B 6/64; H05B 6/6444; H05B 6/72
(Continued)

(56) References Cited

U.S. PATENT DOCUMENTS 1,141,176 A 6/1915 Copeman
1,380,656 A 6/1921 Lauth
(Continued)

FOREIGN PATENT DOCUMENTS

CA 2365023 A1 7/2002
CA 2734926 A1 10/2011
(Continued)

OTHER PUBLICATIONS

Built-In Gas Cooktop, image post date Feb. 18, 2015, in U.S. Appl. No. 29/539,768 in Restriction Requirement dated Oct. 27, 2016, 10 pages, <http://www.bestbuy.com/site/kitchenaid-36-built-in-gas-cooktop-stainless-steel/8636634.p?skuId=8636634>.
(Continued)

*Primary Examiner* — Helena Kosanovic
*Assistant Examiner* — Ayub A Maye
(74) *Attorney, Agent, or Firm* — Price Heneveld LLP

(57) ABSTRACT

An appliance, such as an oven, includes a housing having an internal compartment and an RF antenna. At least a portion of the housing comprises an electrically conductive portion. The antenna includes an active component and a connection to the electrically conductive portion, which serves as a ground plane of the antenna. The housing may include a door assembly having a window that includes the electrically conductive portion in the form of a transparent conductive layer. The door assembly may be detachable and the connection to the antenna may be made by way of capacitive coupling. In an alternative arrangement, the housing includes a light fixture for illuminating the internal compartment, wherein the active component of the antenna is disposed in the light fixture.

13 Claims, 7 Drawing Sheets

(51) Int. Cl.
*H05B 6/64* (2006.01)
*H01Q 1/38* (2006.01)

(58) Field of Classification Search
USPC ..... 99/324, 342, 451; 219/622, 710, 711, 219/712, 713, 391, 392
See application file for complete search history.

(56) References Cited

U.S. PATENT DOCUMENTS 1,405,624 A 2/1922 Patterson
1,598,996 A 9/1926 Wheelock
1,808,550 A 6/1931 Harpman
2,024,510 A 12/1935 Crisenberry
2,530,991 A 11/1950 Reeves
2,536,613 A 1/1951 Schulze et al.
2,699,912 A 1/1955 Cushman
2,777,407 A 1/1957 Schindler
2,781,038 A 2/1957 Sherman
2,791,366 A 5/1957 Geisler
2,815,018 A 12/1957 Collins
2,828,608 A 4/1958 Cowlin et al.
2,847,932 A 8/1958 More
2,930,194 A 5/1960 Perkins
2,934,957 A 5/1960 Reinhart et al.
D191,085 S 8/1961 Kindl et al.
3,017,924 A 1/1962 Jenson
3,051,813 A 8/1962 Busch et al.
3,065,342 A 11/1962 Worden
3,089,407 A 5/1963 Kinkle
3,259,120 A 7/1966 Keating
3,386,431 A 6/1968 Branson
3,463,138 A 8/1969 Lotter et al.
3,489,135 A 1/1970 Astrella
3,548,154 A 12/1970 Christiansson
3,602,131 A 8/1971 Dadson
3,645,249 A 2/1972 Henderson et al.
3,651,300 A * 3/1972 Haagensen ..... H05B 6/6417 219/744
3,691,937 A 9/1972 Meek et al.
3,731,035 A 5/1973 Jarvis et al.
3,749,875 A * 7/1973 Fitzmayer ..... H05B 6/6432 219/737
3,777,985 A 12/1973 Hughes et al.
3,780,954 A 12/1973 Genbauffs
3,857,254 A 12/1974 Lobel
3,877,865 A 4/1975 Duperow
3,899,655 A 8/1975 Skinner
D245,663 S 9/1977 Gordon
4,104,952 A 8/1978 Brass
4,149,518 A 4/1979 Schmidt et al.
4,363,956 A 12/1982 Scheidler et al.
4,413,610 A 11/1983 Berlik
4,418,456 A 12/1983 Riehl
4,447,711 A 5/1984 Fischer
4,466,789 A 8/1984 Riehl
4,518,346 A 5/1985 Pistien
4,555,606 A * 11/1985 Thomas ..... F24C 14/02 126/21 A
4,556,771 A * 12/1985 Thomas ..... H05B 6/6405 219/685
4,587,946 A 5/1986 Doyon et al.
4,646,963 A 3/1987 Delotto et al.
4,654,508 A 3/1987 Logel et al.
4,689,961 A 9/1987 Stratton
4,812,624 A 3/1989 Kern
4,818,824 A 4/1989 Dixit et al.
4,846,671 A 7/1989 Kwiatek
4,886,043 A 12/1989 Homer
4,891,936 A 1/1990 Shekleton et al.
D309,398 S 7/1990 Lund
4,981,416 A 1/1991 Nevin et al.
4,989,404 A 2/1991 Shekleton
5,021,762 A 6/1991 Hetrick
5,136,277 A 8/1992 Civanelli et al.
5,171,951 A 12/1992 Chartrain et al.
D332,385 S 1/1993 Adams
5,215,074 A 6/1993 Nilson et al.
5,243,172 A 9/1993 Hazan et al.
D340,383 S 10/1993 Addison et al.
5,272,317 A 12/1993 Ryu
D342,865 S 1/1994 Addison et al.
5,316,423 A 5/1994 Kin
5,397,234 A 3/1995 Kwiatek
5,448,036 A 9/1995 Husslein et al.
D364,993 S 12/1995 Andrea
5,491,423 A 2/1996 Turetta
D369,517 S 5/1996 Ferlin
5,546,927 A 8/1996 Lancelot
5,571,434 A 11/1996 Cavener et al.
D378,578 S 3/1997 Eberhardt
5,618,458 A 4/1997 Thomas
5,649,822 A 7/1997 Gertler et al.
5,735,261 A 4/1998 Kieslinger
5,785,047 A 7/1998 Bird et al.
5,824,999 A * 10/1998 Kim ..... H05B 6/763 174/385
5,842,849 A 12/1998 Huang
5,913,675 A 6/1999 Vago et al.
5,928,540 A 7/1999 Antoine et al.
D414,377 S 9/1999 Huang
5,967,021 A 10/1999 Yung
6,016,096 A 1/2000 Barnes et al.
6,030,207 A 2/2000 Saleri
6,049,267 A 4/2000 Barnes et al.
6,050,176 A 4/2000 Schultheis et al.
6,078,243 A 6/2000 Barnes et al.
6,089,219 A 7/2000 Kodera et al.
6,092,518 A 7/2000 Dane
6,111,229 A 8/2000 Schultheis
6,114,665 A 9/2000 Garcia et al.
6,133,816 A 10/2000 Barnes et al.
6,155,820 A 12/2000 Döbbeling et al.
6,188,045 B1 2/2001 Hansen et al.
6,192,669 B1 2/2001 Keller et al.
6,196,113 B1 3/2001 Yung
6,253,759 B1 7/2001 Giebel et al.
6,253,761 B1 7/2001 Shuler et al.
6,320,169 B1 11/2001 Clothier
6,322,354 B1 11/2001 Carbone et al.
6,362,458 B1 3/2002 Sargunam et al.
6,377,221 B1 * 4/2002 Lindenmeier ..... H01Q 23/00 343/712
6,452,136 B1 9/2002 Berkcan et al.
6,452,141 B1 9/2002 Shon
6,469,286 B1 * 10/2002 Nobue ..... H05B 6/705 219/746
6,589,046 B2 7/2003 Harneit
6,614,006 B2 9/2003 Pastore et al.
6,619,280 B1 9/2003 Zhou et al.
6,655,954 B2 12/2003 Dane
6,663,009 B1 12/2003 Bedetti et al.
6,718,965 B2 4/2004 Rummel et al.
6,733,146 B1 5/2004 Vastano
6,806,444 B2 10/2004 Lerner
6,837,151 B2 1/2005 Chen
6,891,133 B2 5/2005 Shozo et al.
6,910,342 B2 6/2005 Berns et al.
6,930,287 B2 8/2005 Gerola et al.
6,953,915 B2 10/2005 Garris, III
7,005,614 B2 2/2006 Lee
7,017,572 B2 3/2006 Cadima
D524,105 S 7/2006 Poltronieri
7,083,123 B2 8/2006 Molla
7,220,945 B1 5/2007 Wang
D544,753 S 6/2007 Tseng
7,274,008 B2 9/2007 Valero et al.
7,281,715 B2 10/2007 Boswell
7,291,009 B2 11/2007 Kamal et al.
7,315,247 B2 1/2008 Jung et al.
7,325,480 B2 2/2008 Grühbaum et al.
D564,296 S 3/2008 Koch et al.
7,348,520 B2 3/2008 Wang
7,368,685 B2 5/2008 Nam et al.

(56) References Cited

U.S. PATENT DOCUMENTS 7,411,160 B2 8/2008 Duncan et al.
7,414,203 B2 8/2008 Winkler
7,417,204 B2 8/2008 Nam et al.
D581,736 S 12/2008 Besseas
7,468,496 B2 12/2008 Marchand
D592,445 S 5/2009 Sorenson et al.
7,527,495 B2 5/2009 Yam et al.
D598,959 S 8/2009 Kiddoo
7,589,299 B2 9/2009 Fisher et al.
D604,098 S 11/2009 Hamlin
7,614,877 B2 11/2009 McCrorey et al.
7,628,609 B2 12/2009 Pryor et al.
7,640,930 B2 1/2010 Little et al.
7,696,454 B2 4/2010 Nam et al.
7,708,008 B2 5/2010 Elkasevic et al.
7,721,727 B2 5/2010 Kobayashi
7,731,493 B2 6/2010 Starnini et al.
7,762,250 B2 7/2010 Elkasevic et al.
7,770,985 B2 8/2010 Davis et al.
7,781,702 B2 8/2010 Nam et al.
7,823,502 B2 11/2010 Hecker et al.
7,829,825 B2 11/2010 Kühne
7,840,740 B2 11/2010 Minoo
7,841,333 B2 11/2010 Kobayashi
7,919,736 B2 * 4/2011 Ikeda ..... F24C 15/02 219/702
7,964,823 B2 6/2011 Armstrong et al.
D642,675 S 8/2011 Scribano et al.
8,006,687 B2 8/2011 Watkins et al.
8,015,821 B2 9/2011 Spytek
8,037,689 B2 10/2011 Oskin et al.
8,057,223 B2 11/2011 Pryor et al.
8,141,549 B2 3/2012 Armstrong et al.
8,217,314 B2 7/2012 Kim et al.
8,220,450 B2 7/2012 Luo et al.
8,222,578 B2 7/2012 Beier
D665,491 S 8/2012 Goel et al.
8,272,321 B1 9/2012 Kalsi et al.
8,288,690 B2 10/2012 Boubeddi et al.
8,302,593 B2 11/2012 Cadima
8,304,695 B2 11/2012 Bonuso et al.
8,342,165 B2 1/2013 Watkins
8,344,292 B2 1/2013 Franca et al.
8,393,317 B2 3/2013 Sorenson et al.
8,398,303 B2 3/2013 Kuhn
8,430,310 B1 4/2013 Ho et al.
8,464,703 B2 6/2013 Ryu et al.
D685,225 S 7/2013 Santoyo et al.
D687,675 S 8/2013 Filho et al.
8,526,935 B2 9/2013 Besore et al.
8,535,052 B2 9/2013 Cadima
D693,175 S 11/2013 Saubert
8,584,663 B2 11/2013 Kim et al.
8,596,259 B2 12/2013 Padgett et al.
8,616,193 B2 12/2013 Padgett
8,660,297 B2 2/2014 Yoon et al.
8,687,842 B2 4/2014 Yoon et al.
8,689,782 B2 4/2014 Padgett
8,707,945 B2 4/2014 Hasslberger et al.
8,747,108 B2 6/2014 Lona Santoyo et al.
8,783,167 B1 * 7/2014 Titel ..... F24C 7/085 99/325
8,800,543 B2 8/2014 Simms et al.
D718,061 S 11/2014 Wu
8,887,710 B2 11/2014 Rossi et al.
8,930,160 B2 1/2015 Wall et al.
8,932,049 B2 1/2015 Ryu et al.
8,950,389 B2 2/2015 Horstkoetter et al.
8,978,637 B2 3/2015 Ryu et al.
D727,489 S 4/2015 Rohskopf et al.
9,021,942 B2 5/2015 Lee et al.
9,074,765 B2 7/2015 Armanni
D735,525 S 8/2015 Nguyen
9,113,503 B2 8/2015 Valero et al.
9,132,302 B2 9/2015 Luongo et al.
D743,203 S 11/2015 Filho et al.
9,175,858 B2 11/2015 Tisselli et al.
9,179,506 B2 * 11/2015 Sim ..... H05B 6/763
D750,314 S 2/2016 Hobson et al.
9,307,888 B2 4/2016 Baldwin et al.
D758,107 S 6/2016 Hamilton
D766,036 S 9/2016 Koch et al.
D766,696 S 9/2016 Kemker
9,513,015 B2 12/2016 Estrella et al.
9,521,708 B2 12/2016 Edelmann et al.
9,557,063 B2 1/2017 Cadima
9,572,475 B2 2/2017 Gephart et al.
9,644,847 B2 5/2017 Bhogal et al.
9,696,042 B2 7/2017 Hasslberger et al.
9,879,864 B2 1/2018 Gutierrez et al.
9,927,129 B2 3/2018 Bhogal et al.
2002/0065039 A1 5/2002 Benezech et al.
2004/0007566 A1 1/2004 Staebler et al.
2004/0031782 A1 2/2004 Westfield
2004/0164075 A1 * 8/2004 Henze ..... H05B 6/6414 219/740
2004/0195399 A1 10/2004 Molla
2004/0224273 A1 11/2004 Inomata
2004/0224274 A1 11/2004 Tomiura
2005/0029245 A1 2/2005 Gerola et al.
2005/0112520 A1 5/2005 Todoli et al.
2005/0199232 A1 9/2005 Gama et al.
2005/0268000 A1 12/2005 Carlson
2005/0268794 A1 12/2005 Nesterov
2006/0138127 A1 * 6/2006 Kawashima ..... H05B 6/766 219/730
2006/0157482 A1 * 7/2006 Lingenheil ..... H05B 6/642 219/757
2007/0124972 A1 6/2007 Ratcliffe
2007/0181410 A1 8/2007 Baier
2007/0251936 A1 11/2007 Nam et al.
2007/0281267 A1 12/2007 Li
2008/0029081 A1 2/2008 Gagas
2008/0050687 A1 2/2008 Wu
2008/0173632 A1 7/2008 Jang et al.
2008/0210685 A1 * 9/2008 Beier ..... G01K 1/024 219/713
2008/0223855 A1 * 9/2008 Boxman ..... H05B 6/6414 219/740
2009/0173730 A1 7/2009 Baier et al.
2009/0188396 A1 * 7/2009 Hofmann ..... G01K 1/024 99/342
2009/0320823 A1 12/2009 Padgett
2010/0035197 A1 2/2010 Cadima
2010/0114339 A1 5/2010 Kaiser et al.
2010/0126496 A1 5/2010 Luo et al.
2010/0192784 A1 * 8/2010 Shim ..... F24C 7/082 99/325
2010/0192939 A1 8/2010 Parks
2011/0142998 A1 6/2011 Johncock et al.
2011/0163086 A1 7/2011 Arjol et al.
2011/0248021 A1 10/2011 Sutierrez et al.
2012/0017595 A1 1/2012 Liu
2012/0024835 A1 2/2012 Artal Lahoz et al.
2012/0036855 A1 2/2012 Hull et al.
2012/0067334 A1 3/2012 Kim et al.
2012/0076351 A1 3/2012 Yoon et al.
2012/0099761 A1 4/2012 Yoon et al.
2012/0160228 A1 6/2012 Kim et al.
2012/0171343 A1 7/2012 Cadima et al.
2012/0261405 A1 10/2012 Kurose et al.
2013/0043239 A1 2/2013 Anton Falcon et al.
2013/0252188 A1 9/2013 Chen
2013/0255663 A1 10/2013 Cadima et al.
2013/0260618 A1 10/2013 Bally et al.
2013/0277353 A1 * 10/2013 Joseph ..... H05B 1/0263 219/209
2013/0314226 A1 * 11/2013 Zhang ..... G08B 21/24 340/539.11
2014/0048055 A1 2/2014 Ruther
2014/0071019 A1 3/2014 Lim
2014/0090636 A1 4/2014 Bettinzoli
2014/0097172 A1 4/2014 Kang et al.

(56) References Cited

U.S. PATENT DOCUMENTS

| | | | | |
|---|---|---|---|---|
| 2014/0116416 | A1 | 5/2014 | Saubert | |
| 2014/0137751 | A1* | 5/2014 | Bellm | G01K 1/024 99/342 |
| 2014/0139381 | A1* | 5/2014 | Sippel | F24C 15/024 343/702 |
| 2014/0174489 | A1* | 6/2014 | Cottrell | A47L 15/0018 134/56 D |
| 2014/0318527 | A1 | 10/2014 | Silva et al. | |
| 2014/0352549 | A1 | 12/2014 | Upston et al. | |
| 2015/0096974 | A1 | 4/2015 | Freeman et al. | |
| 2015/0136760 | A1 | 5/2015 | Lima et al. | |
| 2015/0153041 | A1 | 6/2015 | Neumeier | |
| 2015/0241069 | A1 | 8/2015 | Brant et al. | |
| 2015/0330640 | A1 | 11/2015 | Wersborg | |
| 2015/0345800 | A1 | 12/2015 | Cabrera Botello | |
| 2015/0359045 | A1 | 12/2015 | Neukamm et al. | |
| 2016/0029439 | A1 | 1/2016 | Kurose et al. | |
| 2016/0061490 | A1 | 3/2016 | Cho et al. | |
| 2016/0091210 | A1 | 3/2016 | Ceccoli | |
| 2016/0095469 | A1 | 4/2016 | Gregory et al. | |
| 2016/0116160 | A1 | 4/2016 | Takeuchi | |
| 2016/0153666 | A1 | 6/2016 | Tcaciuc | |
| 2016/0174768 | A1 | 6/2016 | Deverse | |
| 2016/0178209 | A1 | 6/2016 | Park et al. | |
| 2016/0178212 | A1 | 6/2016 | Park et al. | |
| 2016/0187002 | A1 | 6/2016 | Ryu et al. | |
| 2016/0201902 | A1 | 7/2016 | Cadima | |
| 2016/0209044 | A1 | 7/2016 | Cadima | |
| 2016/0209045 | A1 | 7/2016 | Millius | |
| 2016/0219656 | A1* | 7/2016 | Hunter, Jr. | H05B 6/763 |
| 2016/0295644 | A1 | 10/2016 | Khokle et al. | |
| 2016/0296067 | A1 | 10/2016 | Laws | |
| 2016/0327279 | A1* | 11/2016 | Bhogal | F24C 7/086 |
| 2017/0003033 | A1 | 1/2017 | Lona Santoyo et al. | |
| 2017/0067651 | A1 | 3/2017 | Khokle et al. | |
| 2017/0074522 | A1 | 3/2017 | Cheng | |
| 2017/0082296 | A1 | 3/2017 | Jeong et al. | |
| 2017/0082299 | A1 | 3/2017 | Rowley et al. | |
| 2017/0108228 | A1 | 4/2017 | Park et al. | |
| 2017/0115008 | A1 | 4/2017 | Erbe et al. | |
| 2017/0261213 | A1 | 4/2017 | Park et al. | |
| 2017/0223774 | A1 | 8/2017 | Cheng et al. | |
| 2018/0035495 | A1* | 2/2018 | Millett | H05B 6/666 |
| 2018/0058702 | A1 | 3/2018 | Jang et al. | |

FOREIGN PATENT DOCUMENTS

| | | | |
|---|---|---|---|
| CN | 201680430 | U | 12/2010 |
| DE | 2845869 | A1 | 4/1980 |
| DE | 3014908 | A1 | 10/1981 |
| DE | 3238441 | A1 | 4/1984 |
| DE | 3446621 | A1 | 6/1986 |
| DE | 3717728 | A1 | 12/1988 |
| DE | 3150450 | C2 | 8/1989 |
| DE | 3839657 | A1 | 5/1990 |
| DE | 4103664 | C1 | 1/1992 |
| DE | 4445594 | A1 | 6/1996 |
| DE | 10218294 | A1 | 11/2003 |
| DE | 60004581 | T2 | 6/2004 |
| DE | 102004002466 | A1 | 8/2005 |
| DE | 19912452 | B4 | 10/2007 |
| DE | 102006034391 | A1 | 1/2008 |
| DE | 102007021297 | A1 | 11/2008 |
| DE | 102008027220 | A1 | 12/2009 |
| DE | 102008042467 | A1 | 4/2010 |
| DE | 102009002276 | A1 | 10/2010 |
| DE | 102013218714 | A1 | 4/2014 |
| EP | 0122966 | A2 | 10/1984 |
| EP | 0429120 | A2 | 5/1991 |
| EP | 0620698 | A1 | 10/1994 |
| EP | 0690659 | A2 | 1/1996 |
| EP | 1030114 | A1 | 8/2000 |
| EP | 1217306 | A2 | 6/2002 |
| EP | 1344986 | A1 | 9/2003 |
| EP | 1586822 | A1 | 10/2005 |
| EP | 1099905 | B1 | 2/2006 |
| EP | 1201998 | B1 | 3/2006 |
| EP | 1460342 | B1 | 5/2006 |
| EP | 2063181 | A2 | 5/2009 |
| EP | 2063444 | A1 | 5/2009 |
| EP | 2116775 | A1 | 11/2009 |
| EP | 2116829 | A1 | 11/2009 |
| EP | 2278227 | A2 | 1/2011 |
| EP | 2299181 | A1 | 3/2011 |
| EP | 2375170 | A1 | 10/2011 |
| EP | 2144012 | B1 | 9/2012 |
| EP | 2657615 | A1 | 10/2013 |
| EP | 2816291 | A1 | 12/2014 |
| EP | 2835580 | A2 | 2/2015 |
| EP | 3006832 | A1 | 4/2016 |
| EP | 2848867 | B1 | 9/2017 |
| FR | 2787556 | A1 | 6/2000 |
| FR | 2789753 | A1 | 8/2000 |
| FR | 3003338 | A1 | 9/2014 |
| GB | 2158225 | A | 11/1985 |
| JP | 2001141244 | A | 5/2001 |
| JP | 2003227615 | A * | 8/2003 |
| JP | 2005009693 | A | 1/2005 |
| JP | 2007147131 | A | 6/2007 |
| JP | 2010038475 | A | 2/2010 |
| JP | 2011257021 | A | 12/2011 |
| WO | 1991013526 | A1 | 9/1991 |
| WO | 9850736 | A1 | 11/1998 |
| WO | 2006072388 | A1 | 7/2006 |
| WO | 2006136363 | A1 | 12/2006 |
| WO | 2012077050 | A2 | 6/2012 |
| WO | 2013098330 | A2 | 7/2013 |
| WO | 2013182410 | A1 | 12/2013 |
| WO | WO 2014/194176 | A1 | 12/2014 |
| WO | WO 2015/086420 | A1 | 6/2015 |

OTHER PUBLICATIONS

True-Heat burner, image post date Jan. 30, 2015, in U.S. Appl. No. 29/539,768 in Restriction Requirement dated Oct. 27, 2016, 2 pages, <http://ovens.reviewed.com/news/kitchenaid-has-a-new-flame>.

Metal Cover Gas Hob, image post date 2012, in U.S. Appl. No. 29/539,768 in Restriction Requirement dated Oct. 27, 2016, 13 pages, <http://inse.gmc.globalmarket.com/products/details/metal-cover-gas-hob-8516959.html>.

Penny Stove, image post date 2004, in U.S. Appl. No. 29/539,768 in Restriction Requirement dated Oct. 27, 2016, 30 pages, <http://www.jureystudio.com/pennystove/stoveinstruction.html>.

* cited by examiner

APPLIANCE INCLUDING AN ANTENNA USING A PORTION OF APPLIANCE AS A GROUND PLANE

BACKGROUND

The present device generally relates to household appliances, and more specifically, to an oven appliance.

SUMMARY

In at least one aspect, an appliance is provided that comprises a housing including an internal compartment, wherein at least a portion of the housing comprises an electrically conductive portion, and an antenna for at least one of receiving RF signals and transmitting RF signals, wherein the antenna comprises an active component and a connection to the electrically conductive portion such that the electrically conductive portion serves as a ground plane of the antenna. According to one variation, the housing further comprises a door assembly having a closed position and an open position for allowing user ingress into the internal compartment, the door assembly including a window for allowing viewing of the internal compartment from outside the internal compartment, and the window including the electrically conductive portion in the form of at least one transparent conductive layer. According to another variation, the housing comprises a light fixture for illuminating the internal compartment, wherein the active component of the antenna is disposed in the light fixture. According to yet another variation, the appliance further comprises: a coaxial cable having a center pin and a metal sheath surrounding the metal pin, and a conductive plate electrically coupled to the center pin, wherein the housing further comprises a door frame and a door assembly detachably mounted to the door frame and having a closed position and an open position for allowing user ingress into the internal compartment, wherein the active component of the antenna is disposed at the door assembly, and wherein the conductive plate is mounted to the door frame and is spaced apart but proximate to the door assembly when the door assembly is in the closed position such that the conductive plate is capacitively coupled to the active component of the antenna when the door assembly is in the closed position.

In at least another aspect, an appliance is provided that comprises a housing including an internal compartment; a door assembly having a closed position and an open position for allowing user ingress into the internal compartment; a window provided in the door assembly for allowing viewing of the internal compartment from outside the compartment, the window including at least one transparent conductive layer; and an antenna for at least one of receiving RF signals and transmitting RF signals, wherein the antenna comprises an active component and a connection to the at least one transparent conductive layer such that the at least one transparent conductive layer serves as a ground plane of the antenna.

In at least another aspect, an appliance is provided that comprises a housing including an internal compartment, wherein at least a portion of the housing comprises an electrically conductive portion, wherein the housing comprises a light fixture for illuminating the internal compartment, and an antenna for at least one of receiving RF signals and transmitting RF signals, wherein the antenna comprises an active component and a connection to the electrically conductive portion such that the electrically conductive portion serves as a ground plane of the antenna, wherein the active component of the antenna is disposed in the light fixture.

These and other features, advantages, and objects of the present device will be further understood and appreciated by those skilled in the art upon studying the following specification, claims, and appended drawings.

DETAILED DESCRIPTION OF EMBODIMENTS

Figure 1:
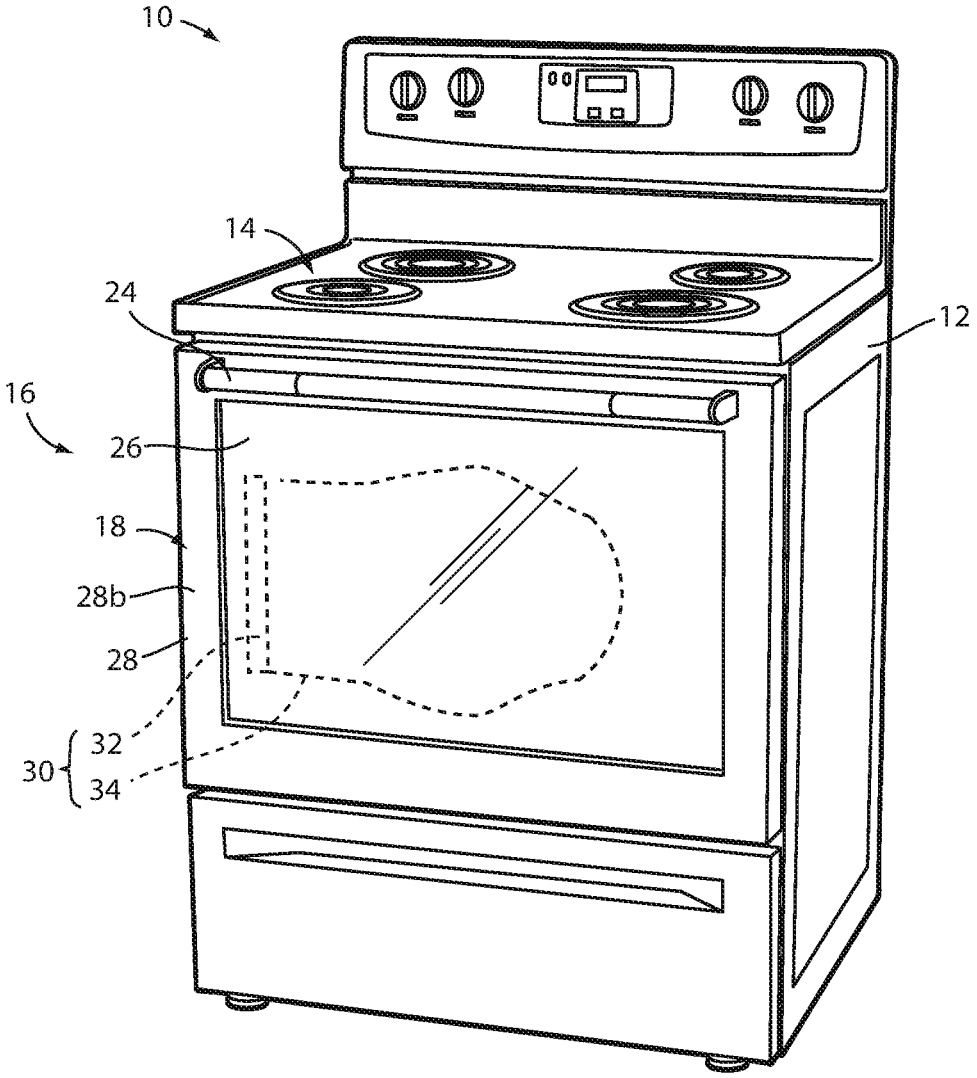
FIG. 1 is a perspective view of one embodiment of an appliance with the door assembly in a closed position.

For purposes of description herein, the terms "upper," "lower," "right," "left," "rear," "front," "vertical," "horizontal," and derivatives thereof shall relate to the appliance as oriented in FIG. 1. However, it is to be understood that the device may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

It is known in the art of cooking appliances to include a temperature probe that may be inserted into the food being cooked. Such temperature probes may communicate via wireless RF signals to an antenna inside an internal compartment of the appliance. However, the integration of antennas into an appliance cavity can be difficult due to style, cleanability, and damage concerns. The antenna should fit within aesthetic considerations and also must be in a place where it cannot be easily damaged. Moreover, in some instances, it may be desirable to transmit RF signals into and out of the internal compartment of the appliance. However, appliances are predominantly made of metal either as inside cavities or external enclosures. In the case of ovens, both internal and external. Door glass can also be coated with metals (such as tin oxide or silver oxide). This leads to a space that is shielded such that transmission of electromagnetic waves is impossible to cross into/out of the appliance.

Antennas are sensitive to metal surroundings. Metal surroundings can inhibit or disrupt the signal radiation. It is difficult to incorporate an antenna inside an oven cavity due to the metal interior and exterior and the aforementioned style, cleanability, and damage concerns. Where the antenna is a patch antenna, the dielectric substrate used between the patch and the ground plane is sensitive to high temperatures. Such high temperatures can result in signal drop or loss.

Referring to the embodiment illustrated in FIG. 1, reference numeral 10 generally designates an appliance. Appliance 10 may be any type of appliance, but is described herein with respect to a cooking appliance such as a range or wall oven. The particular appliance shown in FIG. 1 is a range having a cooktop 14 and an oven 16.

As shown in FIG. 1, appliance 10 generally includes a housing 12 including an internal compartment 20 and an antenna 30 for at least one of receiving RF signals and transmitting RF signals. Antenna 30 includes an active component 32 and a connection to an electrically conductive portion of housing 12 such that the electrically conductive portion serves as a ground plane 34 of antenna 30.

Housing 12 includes a door assembly 18 having a closed position (FIG. 1) and an open position (FIG. 4) for allowing user ingress into internal compartment 20. Door assembly 18 may include a handle 24 and a window 26 for allowing viewing of internal compartment 20 from outside the internal compartment. Window 26 may include the electrically conductive portion in the form of at least one transparent conductive layer 61, 62, 63, 64, 65 (FIG. 3).

Figure 2:
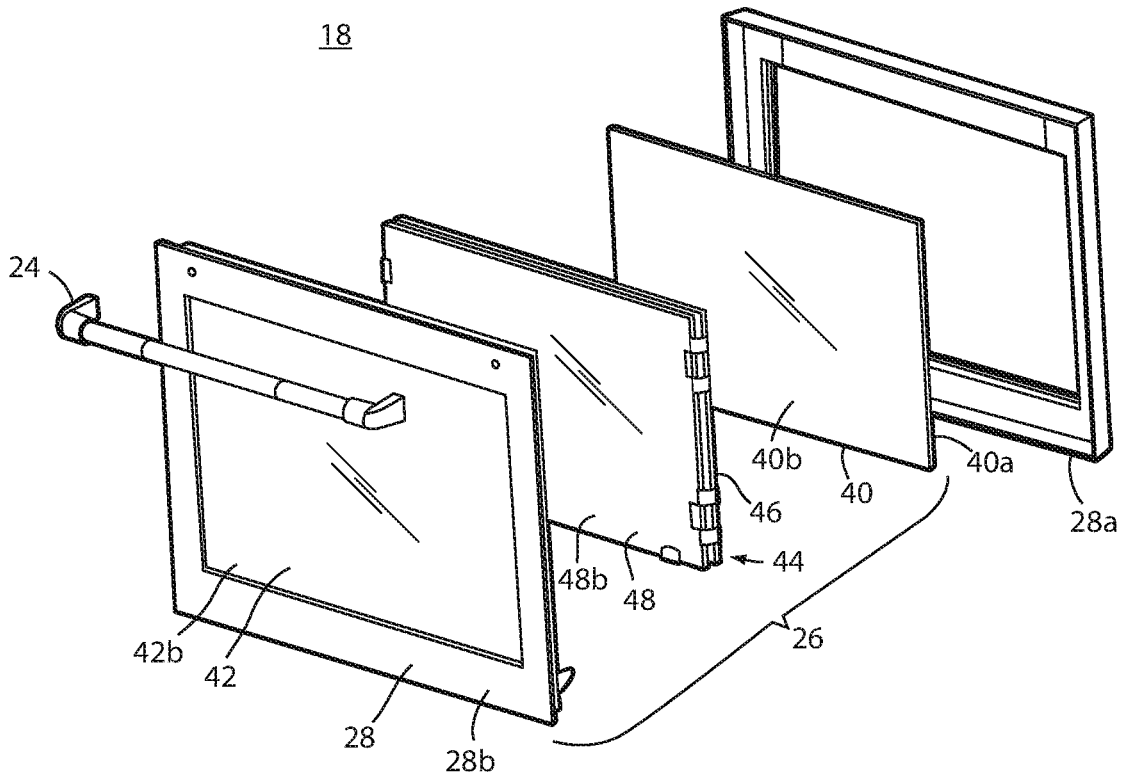
FIG. 2 is an exploded view of a door assembly of the appliance shown in FIG. 1.

Window 26 may include multiple spaced glass panes. As shown in FIGS. 2 and 3, window 26 includes an interior glass substrate 40 having an interior surface 40*a* facing internal compartment 20 and an exterior surface 40*b*, and an exterior glass substrate 42 having an interior surface 42*a* facing exterior surface 40*b* of interior glass substrate 40 and an exterior surface 42*b* that may constitute the outermost surface of window 26. Window 26 may also include an insulated window pack 44 including a first glass sheet 46 and a second glass sheet 48. Insulated window pack 44 is disposed between interior glass substrate 40, and said exterior glass substrate 42 First glass sheet 46 is disposed between second glass sheet 48 and interior glass substrate 40. First glass sheet 46 has an interior surface 46*a* and an exterior surface 46*b*. Second glass sheet 48 has an interior surface 48*a* and an exterior surface 48*b*. As described further below, the at least one transparent conductive layer 61, 62, 63, 64, 65 is disposed on a surface of at least one of interior glass substrate 40, exterior glass substrate 42, first glass sheet 46 and second glass sheet 48.

A metal skin 28 of door assembly 18 may be disposed around window 26 and have a front side 28*a* and an interior side 28*b*. Metal skin 28 may be made of various materials including stainless steel.

Figure 3:
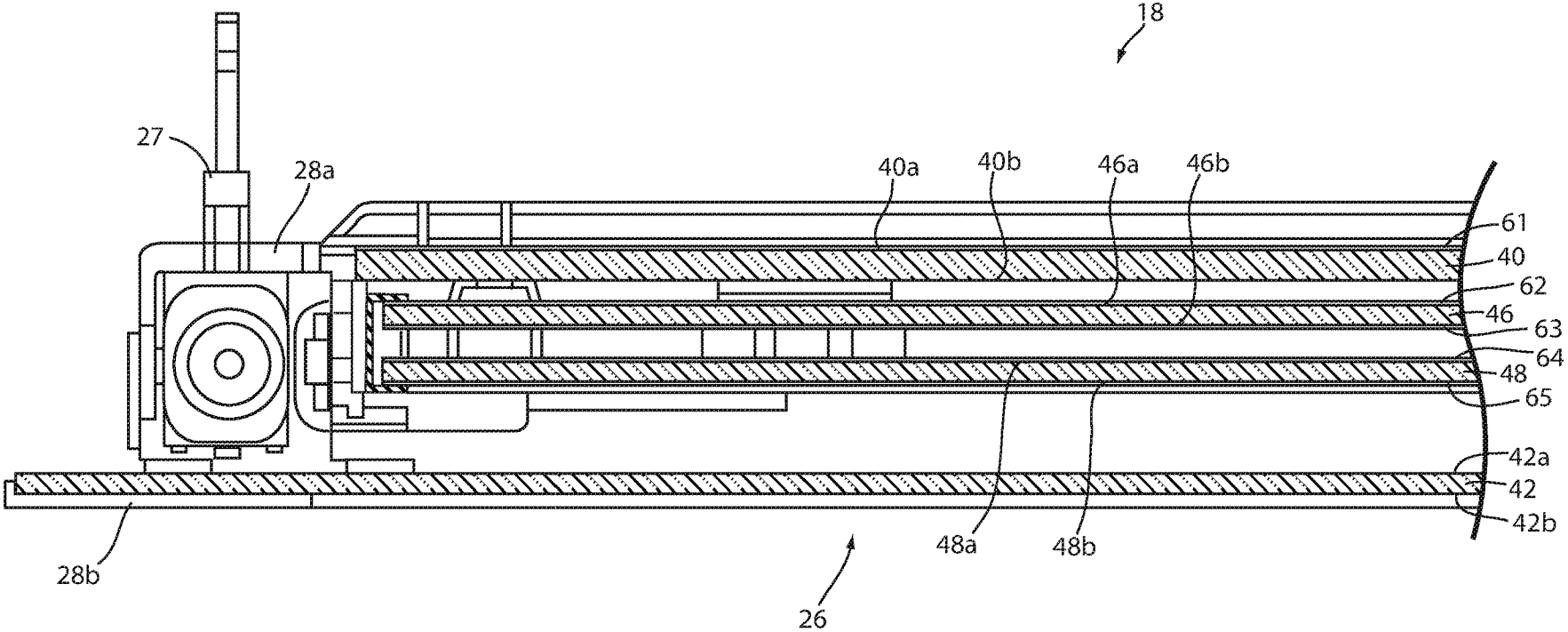
FIG. 3 is a partial cross section of the door assembly of the appliance shown in FIG. 1.

As shown in FIG. 3, the at least one transparent conductive layer may be any one of a plurality of such transparent conductive layers. Oven windows often include a number of transparent metal layers used for heat reflection. These layers may be made of tin oxide or silver oxide. Although these layers are not used for their electrical conductivity, the layers can, in fact, conduct electricity and therefore be used as a ground plane 34 for antenna 30. For example, a first transparent conductive layer 61 may be provided on interior surface 40*a* of interior glass substrate 40. A second transparent conductive layer 62 may be provided on interior surface 46*a* of first glass sheet 46. A third transparent conductive layer 63 may be provided on exterior surface 46*b* of first glass sheet 46. A fourth transparent conductive layer 64 may be provided on interior surface 48*a* of second glass sheet 48. A fifth transparent conductive layer 65 may be provided on exterior surface 48*b* of second glass sheet 48. Any one or more of these layers can be used as the ground plane 34 of antenna 30. The particular transparent conductive layer used as the ground plane 34 may depend on the configuration and location of the active component 32 of antenna 30. Various possible implementations are described below.

Figure 4:
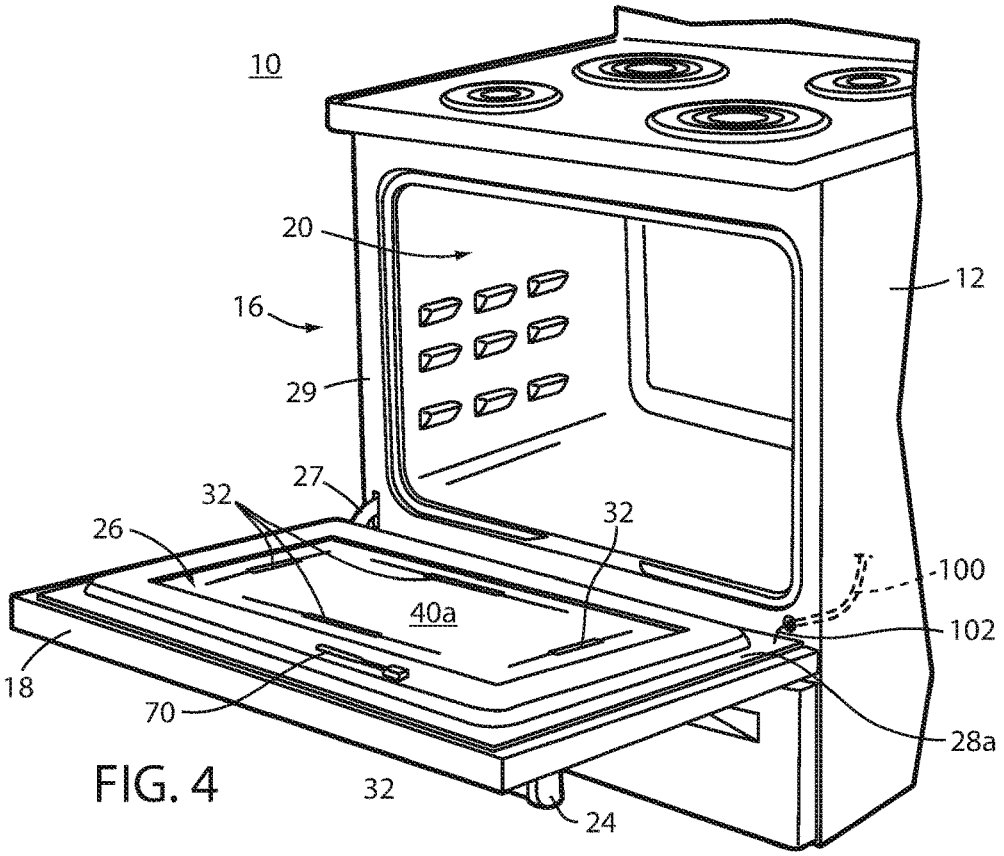
FIG. 4 is a perspective view of an oven portion of the appliance shown in FIG. 1 with the door assembly in an open position.
Figure 5A:
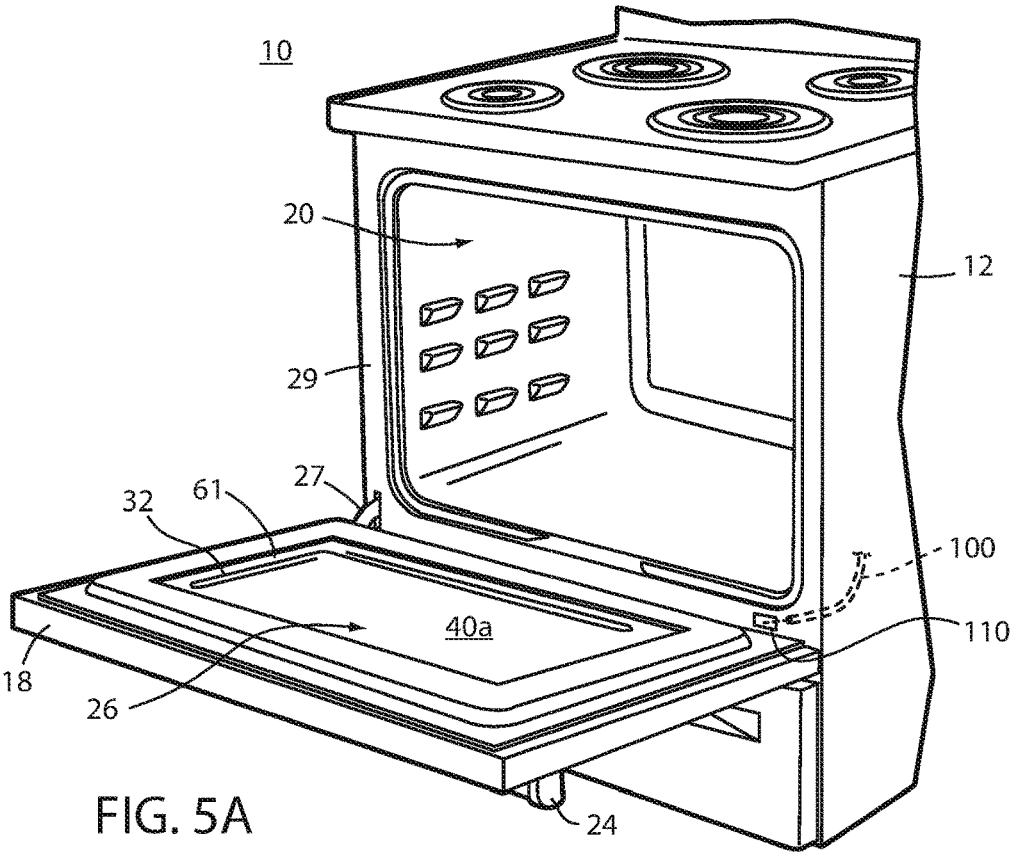
FIG. 5A is a perspective view of an oven portion of the appliance shown in FIG. 1 with an alternate coupling of a coaxial cable to an active component of an antenna disposed at the door assembly.

According to a first implementation, the at least one transparent conductive layer is first transparent conductive layer 61 disposed on interior surface 40*a* of interior glass substrate 40. Thus, first transparent conductive layer 61 serves as ground plane 34 of antenna 30. Active component 32 of antenna 30 includes a thin conductive substance (such as metallic ink, wire, etc.) printed on interior surface 40*a* of interior glass substrate 40. As shown in FIGS. 4 and 5A, the printed thin conductive substance serving as active component 32 may extend along a perimeter of window 26 while being physically separated from ground plane 34 (FIG. 3). In this implementation the antenna would transmit and/or receive signals from within internal compartment 20. Multiple printed thin conductive tracings may be disposed about the perimeter of window 26 to form multiple antennas if desired. The antenna(s) may be monopole or dipole. Note that in FIG. 4, active components 32 would be used in place of metal conductor 70 (described below).

If it is desired to provide exterior signal coverage, active component 32 may be printed on the interior surface 42*a* of exterior glass substrate 42 and the at least one transparent conductive layer is fifth transparent conductive layer 65 disposed on exterior surface 48*b* of second glass sheet 48 such that fifth transparent conductive layer 65 serves as ground plane 34.

As shown in FIG. 4, electrical connection to active component 32 and ground plane 34 of antenna 30 may be made using a coaxial cable 100 having a center pin 102 and a metal sheath 104 that is insulated from center pin 102 and surrounds the center pin. Metal sheath 104 may be electrically coupled to transparent conductive layer 61, 62, 63, 64, 65 (serving as ground plane 34) and center pin 102 may be electrically coupled to said active component 32. Coaxial cable 100 may be run through the hinge that connects door assembly 18 to appliance 10. Another technique for making the coaxial connection is described below with respect to FIGS. 5A and 5B.

According to another implementation, interior side 28*a* of metal skin 28 (which may be stainless steel) surrounding window 26 of door assembly 18 is electrically coupled to center pin 102 such that interior side 28*a* of metal skin 28 acts as active component 32 of antenna 30. In this implementation, the at least one transparent conductive layer 61, 62, 63, 64, 65 is first transparent conductive layer 61 disposed on interior surface 40*a* of interior glass substrate 40 such that first transparent conductive layer 61 serves as ground plane 34. In this arrangement the antenna 30 communicates with one or more devices within the internal compartment 20. To communicate with external devices, the exterior side 28*b* of metal skin 28 may be used as the active component 32 while the at least one transparent conductive layer 61, 62, 63, 64, 65 is fifth transparent conductive layer 65 disposed on exterior surface 48*b* of second glass sheet 48 such that fifth transparent conductive layer 65 serves as ground plane 34.

According to another implementation shown in FIG. 4, a physical antenna 30 may be mounted on door assembly 18. More specifically, a separate metal conductor 70 may be mounted on door assembly 18 to serve as active component 32 while at least one transparent layer 61, 62, 63, 64, 65 in window 26 is used as ground plane 34. For interior signal coverage, separate metal conductor 70 may be mounted on the inside door frame of door assembly 18 and the at least one transparent conductive layer 61, 62, 63, 64, 65 is first transparent conductive layer 61 disposed on interior surface 40*a* of interior glass substrate 40 such that first transparent conductive layer 61 serves as ground plane 34. For exterior signal coverage, separate metal conductor 70 may be mounted on the outside of door assembly 18 and the at least one transparent conductive layer 61, 62, 63, 64, 65 is fifth transparent conductive layer 65 disposed on exterior surface 48*b* of second glass sheet 48 such that fifth transparent conductive layer 65 serves as ground plane 34. One location for the mounting of separate metal conductor 70 on the outside of door assembly 18 is to provide metal conductor 70 in handle 24. Note that metal conductor 70 would be used in place of active components 32 shown in FIG. 4.

In another implementation, a patch antenna may be used for antenna 30. In this case, active component 32 may comprise one of the transparent conductive layers in window 26 while another one of the transparent conductive layers serves as ground plane 34 and air and/or glass is the dielectric layer between active component 32 and ground plane 34. For example, for interior signal coverage, the active component patch 32 may be the first transparent conductive layer 61 disposed on interior surface 40*a* of interior glass substrate 40 while ground plane 34 may be the first transparent conductive layer 61 disposed on interior surface 46*a* of first glass sheet 46 as shown in FIG. 3. For exterior signal coverage, the active component patch 32 may be the fifth transparent conductive layer 65 disposed on exterior surface 48*b* of second glass sheet 48 while ground plane 34 may be the fourth transparent conductive layer 64 disposed on interior surface 48*a* of second glass sheet 48. It should be noted that the two patch antennas may be combined to provide coverage both inside and outside the appliance.

Figure 5B:
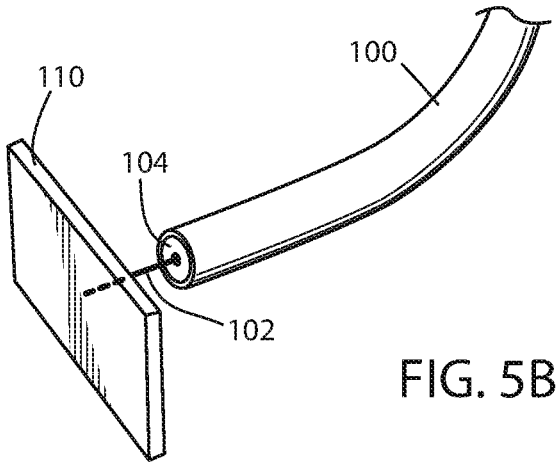
FIG. 5B is an enlarged view of the alternate coupling shown in FIG. 5A.
Figure 6:
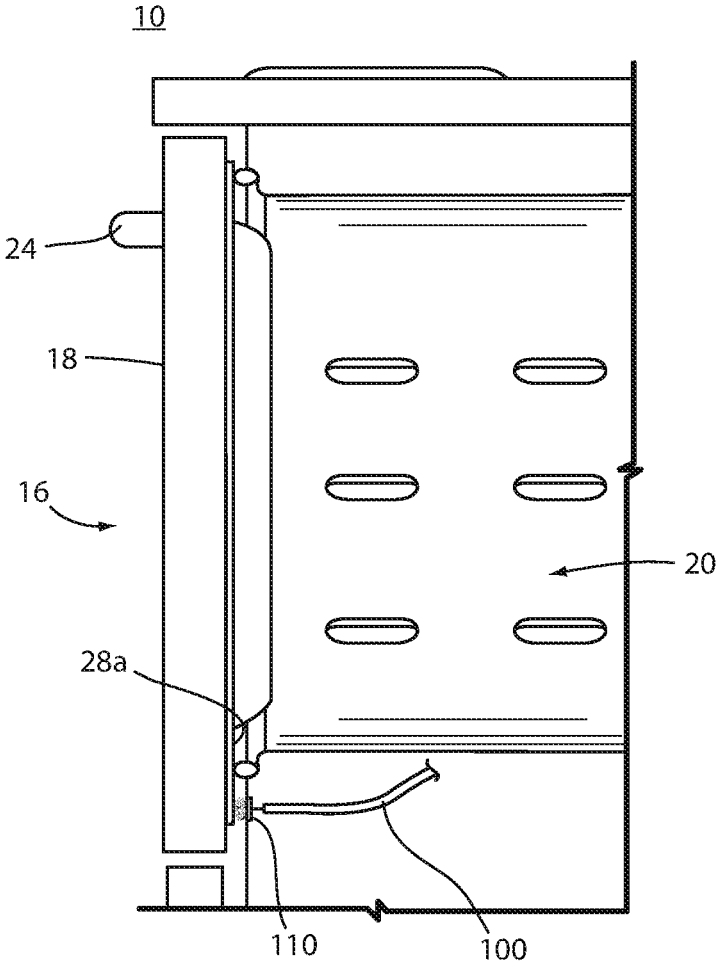
FIG. 6 is a side view of the alternate coupling shown in FIGS. 5A and 5B.
Figure 7:
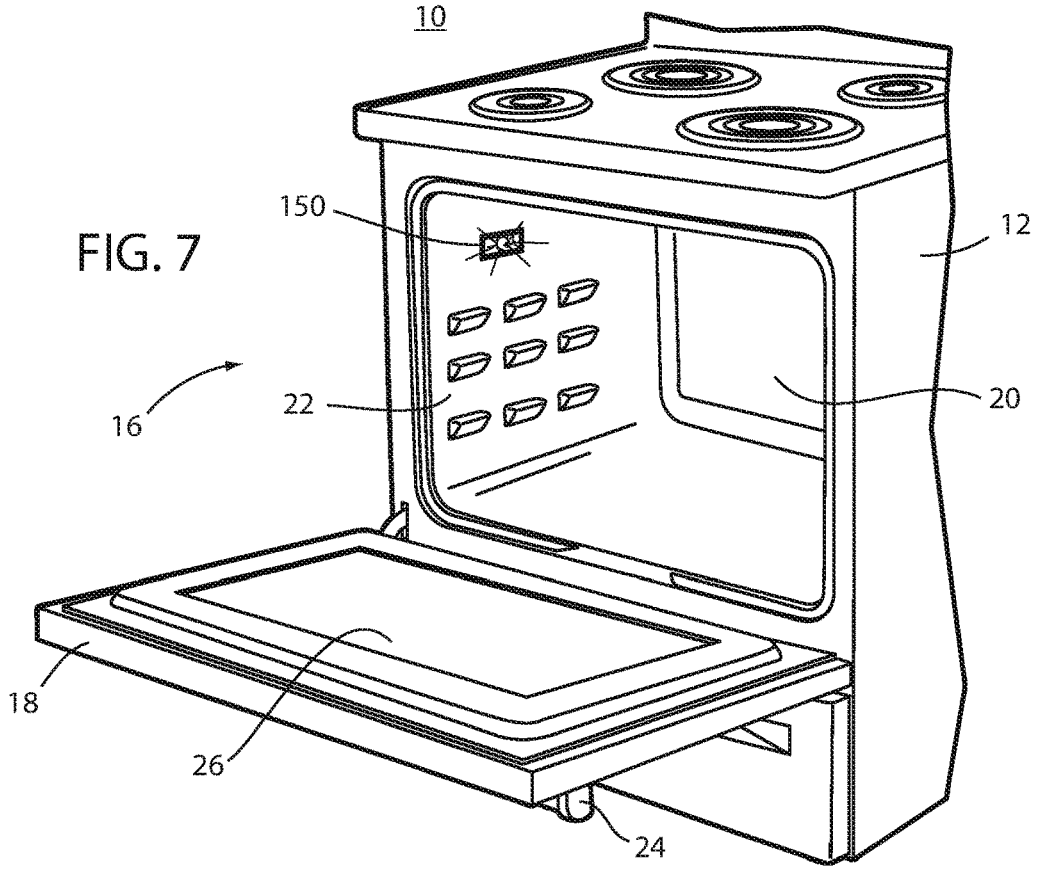
FIG. 7 is a perspective view of the internal compartment of the appliance shown in FIG. 1 having a light fixture.
Figure 8:
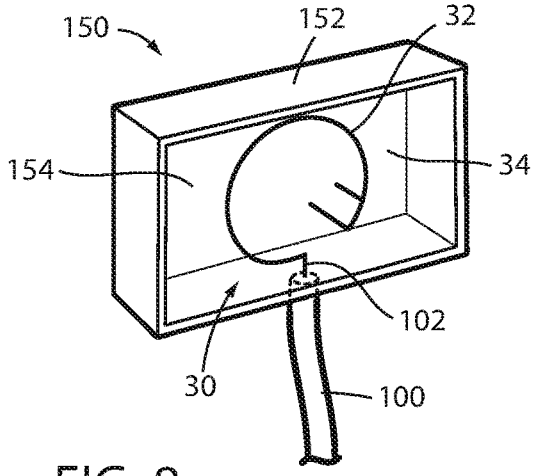
FIG. 8 is a perspective view of the light fixture shown in FIG. 7 with the transparent cover removed.
Figure 9:
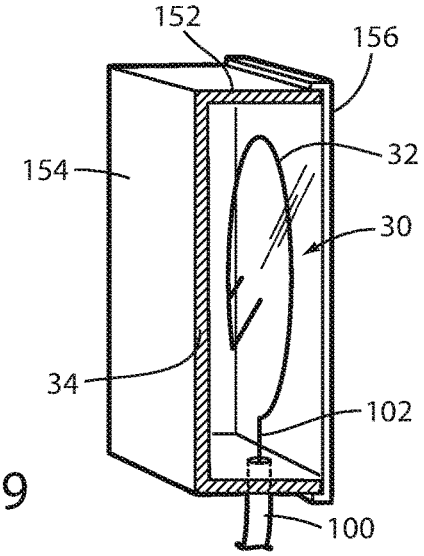
FIG. 9 is a side view of the light fixture shown in FIG. 7.
Figure 10:
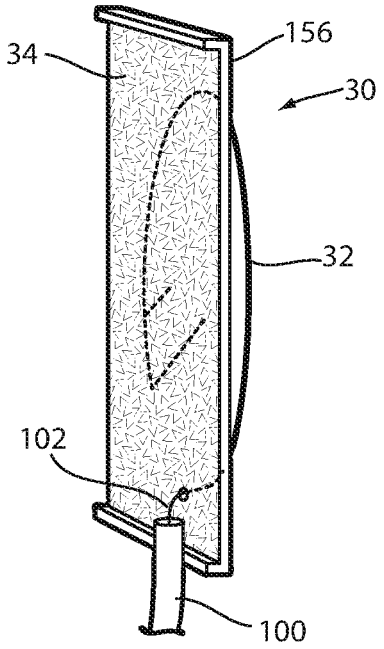
FIG. 10 is a perspective view of the light fixture shown from the rear according to one implementation.
Figure 11:
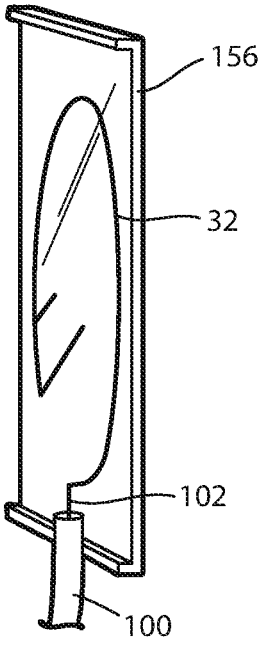
FIG. 11 is a perspective view of the light fixture shown from the rear according to another implementation.

As shown above with respect to FIG. 4, connections to antenna 30 may be made directly (or indirectly) via coaxial cable 100. One way of indirectly coupling antenna 30 to coaxial cable 100 is shown in FIGS. 5A, 5B, and 6 where capacitive coupling is used such that coaxial cable 100 does not need to physically connect to door assembly 18. This provides the benefit that the door assembly 18 may be more easily detached from appliance 10. This can provide a significant advantage in appliances that require detachment of the door assembly due to installation of trim built into the appliance. In this case, a conductive plate 110 is electrically coupled to center pin 102 of coaxial cable 100. Housing 12 may further include a front door frame 29 and door assembly 18 may be detachably mounted to front door frame 29 and having a closed position and an open position for allowing user ingress into internal compartment 20. Conductive plate 110 is mounted to door frame 29 and is spaced apart but proximate to door assembly 18 when door assembly 18 is in the closed position such that conductive plate 110 is capacitively coupled to active component 32 of antenna 30 when door assembly 18 is in the closed position. When the active component 32 is the interior side 28*a* of metal skin 28, the capacitive coupling may be directly between conductive plate 110 and metal skin 28. Alternatively, a second conductive plate may be mounted to the inside of the door assembly 18 opposite conductive plate 110 with the second conductive plate electrically connected to active component 32 via wires or other coaxial cable. If the first transparent conductive layer 61 is acting as the active component 32 of a patch antenna as described above, the conductive plate 110 may be positioned to be opposite first transparent conductive layer 61 so as to be directly capacitively coupled thereto. The connection to ground plane 34 may also be made via the door hinge(s) 27, which may serve as a ground conductor.

As discussed above, there is also the possibility of having multiple antennas mounted to the door assembly 18 as well as multiple conductive plates capacitively coupling the antennas to respective coaxial cables. Providing multiple antennas 30 can help with signal strength and omnidirectionality inside of the internal compartment 20 or to allow communications both inside and outside the appliance.

As shown in FIGS. 7-10, housing 12 may further include a light fixture 150 positioned on an interior wall 22 of internal compartment 20 for illuminating internal compartment 20. As an alternate location for antenna 30 or as a location for an additional antenna to one disposed in door assembly 18, one could provide the antenna 30 in light fixture 150. Specifically, active component 32 of antenna 30 may be disposed in light fixture 150. This location would serve primarily for communication with a device placed inside internal compartment 20. If communication was also desired outside the appliance, an antenna could be disposed elsewhere including the door assembly 18 as described above.

Light fixture 150 may include the electrically conductive portion constituting ground plane 34 of antenna 30. Alternatively, a portion or all of interior wall 22 of housing 12 may include the electrically conductive portion constituting ground plane 34. Light fixture 150 includes an enclosure 152 having at least one metal wall 154, which may serve as ground plane 34. Light fixture 150 includes a transparent cover 156, which may be made of glass, through which light from a light source is transmitted into internal compartment 20. Active component 32 of antenna 30 may be disposed on either surface of transparent cover 156. As shown, the active component 32 may be a circular F antenna. Transparent cover 156 is preferably made of glass, which transmits light and does not inhibit radio waves.

In one implementation, active component 32 is disposed on the surface of transparent cover 156 that faces internal compartment 20. In this case, a transparent conductive coating may be provided on the opposite surface of cover 156 to serve as ground plane 34. Accordingly, metal sheath 104 of coaxial cable 100 is coupled to the transparent conductive coating serving as ground plane 34 and center pin 102 is connected to active component 32, which may be in the form of a wire or printed conductive material.

In another implementation, active component 32 is disposed on the surface of transparent cover 156 opposite the one that faces internal compartment 20. In this case, at least one metal wall 154 of enclosure 152 may serve as ground plane 34. Accordingly, metal sheath 104 of coaxial cable 100 is coupled to metal wall 154 and center pin 102 is connected directly to active component 32 through a hold in the back of enclosure 152 of light fixture 150.

Although the above embodiments are described as having the active component 32 of the antenna 30 provided in door assembly 18 and/or light fixture 150, the active component 32 may be disposed in any other component within internal compartment 20 while a portion of housing 12 may be used as the ground plane 34.

By having the active component 32 of the antenna 30 provided in door assembly 18, light fixture 150, or other component while a portion of housing 12 is used as the ground plane 34, an antenna 30 may be integrated in an appliance in such as way that it does not impact the style or cleanability of the appliance and without raising any damage concerns. Moreover, antennas can be integrated so as to transmit and receive signals into and out of the internal compartment of the appliance. Further, antennas can be integrated into the appliance while using some of the existing structure as a ground plane and/or active component of the antenna and thereby reduce construction time and expense.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms—couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. An oven for heating a food item, the oven comprising:
a housing including an internal compartment for receiving the food item, wherein at least a portion of the housing comprises an electrically conductive portion; and
an antenna for at least one of receiving RF signals and transmitting RF signals from/in a first direction, wherein the antenna comprises an active component and a connection to said electrically conductive portion such that said electrically conductive portion serves as a ground plane of said antenna,
wherein the ground plane is positioned behind the active component relative to the first direction,
wherein said housing further comprises a door assembly having a closed position and an open position for allowing user ingress into said internal compartment, said door assembly including a window for allowing viewing of the internal compartment from outside the internal compartment, said window including:
an interior glass substrate having an interior surface facing said internal compartment and an exterior surface;
an exterior glass substrate having an interior surface facing said exterior surface of said interior glass substrate and an exterior surface; and
said electrically conductive portion in the form of at least one transparent conductive layer positioned on one of the surfaces of either the interior glass substrate or the exterior glass substrate; and
wherein the active component is positioned on another one of the surfaces of either the interior glass substrate or the exterior glass substrate.

2. An appliance comprising:
a housing including an internal compartment, wherein at least a portion of the housing comprises an electrically conductive portion;
an antenna for at least one of receiving RF signals and transmitting RF signals from/in a first direction, wherein the antenna comprises an active component and a connection to said electrically conductive portion such that said electrically conductive portion serves as a ground plane of said antenna, wherein the ground plane is positioned behind the active component relative to the first direction;
a coaxial cable having a center pin and a metal sheath surrounding the center pin; and
a conductive plate electrically coupled to said center pin;
wherein said housing further comprises a door frame and a door assembly detachably mounted to said door frame and having a closed position and an open position for allowing user ingress into said internal compartment, wherein said active component of said antenna is disposed at said door assembly, and wherein said conductive plate is mounted to said door frame and is spaced apart but proximate to said door assembly when said door assembly is in the closed position such that said conductive plate is capacitively coupled to said active component of said antenna when said door assembly is in the closed position.

3. The appliance of claim 2, wherein said door assembly includes a metal skin that is capacitively coupled to said conductive plate when said door assembly is in the closed position, and wherein said metal skin serves as an active component of said antenna.

4. The appliance of claim 2, wherein said door assembly includes a window for allowing viewing of the internal compartment from outside the internal compartment, said window including a glass substrate having an interior surface, wherein said antenna is a patch antenna and said active component of said antenna comprises a transparent metallic layer disposed on said interior surface of said glass substrate, and wherein said transparent metallic layer is capacitively coupled to said conductive plate when said door assembly is in the closed position.

5. An appliance comprising:

a housing including an internal compartment;

a door assembly having a closed position and an open position for allowing user ingress into said internal compartment;

a window provided in said door assembly for allowing viewing of the internal compartment from outside the compartment, said window including:

an interior glass substrate having an interior surface facing said internal compartment and an exterior surface;

an exterior glass substrate having an interior surface facing said exterior surface of said interior glass substrate and an exterior surface; and at least one transparent conductive layer; and an antenna for at least one of receiving RF signals and transmitting RF signals from/in a first direction, wherein said antenna comprises an active component and a connection to said at least one transparent conductive layer such that said at least one transparent conductive layer serves as a ground plane of said antenna, wherein the active component is positioned between the interior glass substrate and the exterior glass substrate and the at least one transparent conductive layer is disposed behind the active component relative to the first direction.

6. The appliance of claim 5, wherein said at least one transparent conductive layer is a layer of tin oxide.

7. The appliance of claim 5, wherein said window further comprises:

an insulated window pack comprising a first glass sheet and a second glass sheet disposed between said interior glass substrate and said exterior glass substrate, said first glass sheet disposed between said second glass sheet and said interior glass substrate, said first glass sheet having an interior surface and an exterior surface, said second glass sheet having an interior surface and an exterior surface, wherein said at least one transparent conductive layer is disposed on a surface of one of said interior glass substrate, said exterior glass substrate, said first glass sheet and said second glass sheet.

8. The appliance of claim 5 and further comprising a coaxial cable having a center pin and a metal sheath surrounding the center pin for electrically coupling to said antenna, wherein said metal sheath is electrically coupled to said at least one transparent conductive layer, said door assembly includes a metal skin surrounding said window on said door assembly, and wherein said center pin is connected to said metal skin such that said metal skin acts as said active component of said antenna.

9. The appliance of claim 5, wherein said active component of said antenna comprises a separate metal conductor mounted to said door assembly.

10. The appliance of claim 5, wherein said active component of said antenna comprises a thin conductive substance printed on one of said interior surface of said exterior glass substrate and said interior surface of said interior glass substrate.

11. The appliance of claim 5, wherein said antenna is a patch antenna and said active component of said antenna comprises a transparent conductive layer disposed on said interior surface of said interior glass substrate.

12. The appliance of claim 5 and further comprising:

a coaxial cable having a center pin and a metal sheath surrounding the metal pin; and a conductive plate electrically coupled to said center pin;

wherein said housing further comprises a door frame, said door assembly detachably mounted to said door frame, wherein said active component of said antenna is disposed at said door assembly, and wherein said conductive plate is mounted to said door frame and is spaced apart but proximate to said door assembly when said door assembly is in the closed position such that said conductive plate is capacitively coupled to said active component of said antenna when said door assembly is in the closed position.

13. An appliance comprising:

a housing including an internal compartment, wherein at least a portion of the housing comprises an electrically conductive portion, wherein said housing comprises a light fixture for illuminating said internal compartment; and an antenna for at least one of receiving RF signals and transmitting RF signals from/in a first direction, wherein the antenna comprises an active component and a connection to said electrically conductive portion such that said electrically conductive portion serves as a ground plane of said antenna, wherein said active component of said antenna is disposed in said light fixture, and wherein the ground plane is positioned behind the active component relative to the first direction, wherein said light fixture includes a transparent cover, and wherein said active component of said antenna is disposed on a surface of said transparent cover that faces said internal compartment, wherein said transparent cover includes a transparent conductive coating on an opposite surface, and wherein said electrically conductive portion is said transparent conductive coating such that said transparent conductive coating constitutes said ground plane of said antenna.

* * * * *